US005232390A

United States Patent [19]

Brooks

[11] Patent Number: 5,232,390

[45] Date of Patent: Aug. 3, 1993

[54] ACTION AMUSEMENT SET WITH MULTI-PURPOSE DOLL

[76] Inventor: Clay Brooks, 2511 Elsinore Ave., Baltimore, Md. 21216

[21] Appl. No.: 921,967

[22] Filed: Aug. 4, 1992

Related U.S. Application Data

[63] Continuation of Ser. No. 813,772, Dec. 27, 1991, abandoned.

[51] Int. Cl.[5] ..... A63H 11/10; A63H 3/14; A63B 63/00

[52] U.S. Cl. ..... 446/72; 446/268; 446/287; 446/327; 446/280; 273/402; 273/29 BB

[58] Field of Search ..... 446/72, 73, 291, 290, 446/279, 97–99, 327, 268, 385, 287, 280; 273/459

[56] References Cited

U.S. PATENT DOCUMENTS

| | | | |
|---|---|---|---|
| 2,019,516 | 11/1935 | Weinberg | 446/100 |
| 2,269,334 | 1/1942 | Bocchino . | |
| 3,186,125 | 6/1965 | Orel . | |
| 3,737,196 | 6/1973 | Bodor | 446/73 X |
| 4,208,832 | 6/1980 | Corriveau . | |
| 4,208,834 | 6/1980 | Lin | 446/226 |
| 4,227,340 | 10/1980 | Goldfarb et al. . | |
| 4,245,426 | 1/1981 | Sullivan . | |
| 4,504,240 | 3/1985 | Thomas | 446/100 |
| 4,579,537 | 4/1986 | Leahy | 446/100 |
| 4,682,969 | 7/1987 | Choy et al. | 446/279 |
| 4,846,752 | 7/1989 | Combs | 446/279 |
| 4,883,441 | 11/1989 | Byer | 446/99 |
| 4,921,458 | 5/1990 | Greenwood | 446/289 X |
| 4,950,196 | 8/1990 | Fortune et al. | 446/73 |

*Primary Examiner*—Mickey Yu
*Attorney, Agent, or Firm*—Venable, Baetjer and Howard

[57] ABSTRACT

The present invention provides an action amusement set having as a primary member a self-propelled, multi-purpose doll that can be disassembled to reveal a gameball usable with various sporting accessories included with the amusement set. The multi-purpose doll is provided with a drive mechanism for propelling and turning the doll. A remote control unit is also provided for remotely controlling the drive mechanism. The action amusement set includes several types of gameballs that can be selectively incorporated in the multi-purpose doll but which are configured for play in connection with a particular sport. The sporting accessories of the amusement set include several components that may be arranged into suitable setups corresponding to a particular sport.

19 Claims, 8 Drawing Sheets

ACTION AMUSEMENT SET WITH MULTI-PURPOSE DOLL

This application is a continuation of application Ser. No. 813,772, filed Dec. 27, 1991, abandoned.

BACKGROUND OF THE INVENTION

The present invention relates to an action amusement set for use by a small child and, in particular, an action set having as a primary component a self-propelled multi-purpose doll that may easily be disassembled and its parts used either alone or in conjunction with other accessories provided with the action set. When using the action amusement set, a small child need only manipulate various of the action set's components to produce different toys with which to play, thereby providing hours of enjoyment. In addition to providing multiple toys, the action amusement set serves as an educational aid for teaching a small child several basic motor skills.

Various dolls are known that may be taken apart and reassembled into either their original configuration or a different configuration. Examples of such toys are described in U.S. Pat. No. 4,208,832 to Corriveau, U.S. Pat. No. 4,579,537 to Leahy, and U.S. Pat. No. 4,883,441 to Byer. Furthermore, various self-propelled toys are in existence. An example of a self-propelled doll that is remotely controlled is described in U.S. Pat. No. 4,846,752. None of these toys, however, provides an action set having interchangeable components that can be manipulated to produce different toys in accordance with the present invention.

SUMMARY OF THE INVENTION

The present invention provides an action amusement set that a small child can, amongst other things, use to practice and play a variety of sports. A primary component of the amusement set is a multi-purpose doll comprising a head section, a torso section removably attachable to the head section, and a leg section removably attachable to the torso section. The torso section comprises a gameball usable with other sporting accessories included in the action set. The multi-purpose doll further comprises a drive mechanism located in the leg section for propelling and turning the leg section. A remote control mechanism is provided for remotely controlling the drive mechanism.

The multi-purpose doll can be disassembled and the head section and torso section used separately by a child. The head section comprises a head member and a ball cover attached to the head member. In one embodiment, the head member is provided with a hole sufficiently large to allow a child's finger to be inserted therein such that the head section may operate as a puppet when the doll is disassembled.

The drive mechanism of the multi-purpose doll comprises a first drive source, a drive wheel coupled to the first drive source and protruding at least partially outside the leg section, a second drive source, and a turning disk coupled to the second driving source and the drive wheel. The first drive source is operable to rotate the drive wheel about a substantially horizontal axis, thereby causing the leg section to move forward. The second drive source is operable to rotate the turning disk, thereby causing the drive wheel and leg section to turn about a substantially vertical axis.

Among the sporting accessories included in the action amusement set is a plurality of replacement gameballs that are interchangeable with the gameball of the torso section. The accessories also include a tripod assembly, comprising three legs and a tri-joint connector for removably connecting the legs, and a net adapted to partially surround the tripod assembly thereby forming a goal into which a child can kick, roll, or throw one of the gameballs. The sporting accessories also include a backboard adapted to be mounted to the tripod assembly and having an opening through which one of the gameballs can be thrown. Other sporting accessories as explained further below are provided with the action set so that a child may arrange different sport setups for play.

BRIEF DESCRIPTION OF THE DRAWINGS

Various objects, advantages and novel features of the invention will be more readily understood from the following detailed description when read in conjunction with the accompanying drawings, in which:

FIG. 3*a* is an enlarged partial view of a section of the motorized unit;

DETAILED DESCRIPTION OF THE PREFERRED EMBODIMENTS

The action amusement set of the present invention can provide a child with hours of enjoyment by exposing him or her to a variety of sports. Included in the action set is a self-propelled, multi-purpose doll that can be disassembled to reveal a gameball usable with various sporting accessories also included with the action amusement set. The action amusement set includes several types of gameballs that can be selectively incorporated in the multi-purpose doll but which are configured for play in connection with a particular sport. The sporting accessories of the amusement set include several components that may be arranged into suitable setups corresponding to a particular sport. When using the action amusement set, a child may choose amongst a variety of games to play. The child can play with the multi-purpose doll separately or, by simple manipulations of the action set components, play one of several different sports available. In addition to providing a child with multiple sources of amusement, the action set also provides an educational aid for teaching the child various basic motor skills.

Figure 1:
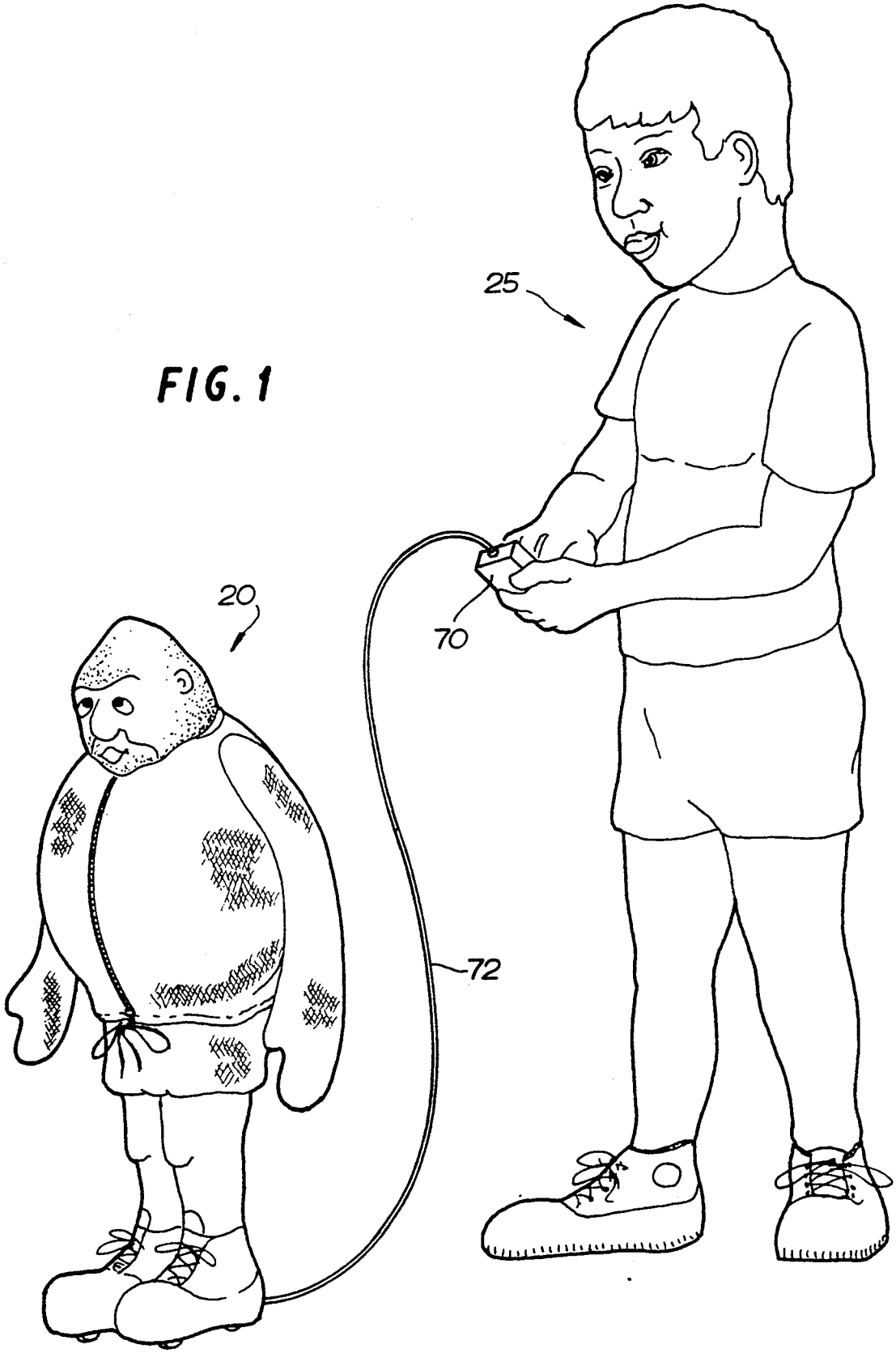
FIG. 1 is a perspective view of a fully assembled multi-purpose doll in accordance with the present invention.

FIG. 1 illustrates the multi-purpose doll 20 that serves as the primary member of the action amusement set. The doll 20, shown in its fully assembled configuration, comprises three major components that are removably joined together. When fully assembled, the doll 20 resembles a caricature of an athlete wearing athletic apparel and may be remotely operated by a child 25 to move forward and to the left or right. When disassembled, two of the major components may be used separately as different toys.

Figure 2:
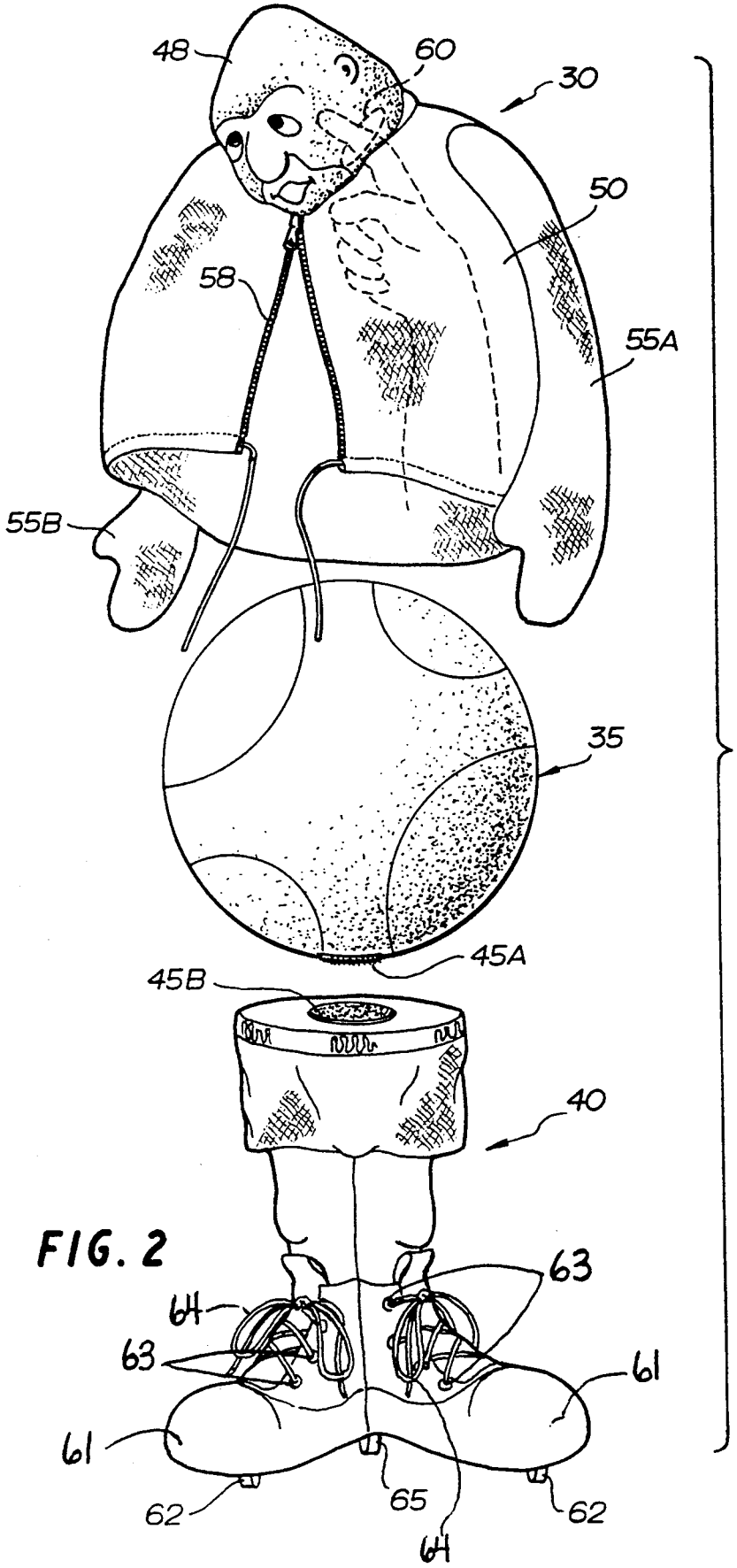
FIG. 2 is an exploded perspective view of the multi-purpose doll disassembled.

With reference to FIG. 2, the three major components are a head section 30, a body section 35 in the form of a gameball, and a leg stand 40 which houses a motorized unit for propelling forward and turning the doll 20. The head section 30 includes a head 48 and a ball cover 50 attached to the head 48 by suitable conventional means such as stitching, glue or the like. Preferably, the head 48 is hollow and made of rubber or other suitable material. The ball cover 50 serves to conceal the gameball 35 when the doll is fully assembled. Preferably, the cover 50 is made of a spandex material which allows the cover to snuggly fit over the gameball 35. Other clothing material, however, may be used as well. Two arm segments 55A and 55B are attached to the outside surface of the ball cover in order to give the toy the appearance of being a complete figure when fully assembled. The arm segments 55A and 55B, preferably are made of cloth and are sewn to an upper part of the cover.

The ball cover 50 includes a zipper 58 that allows the cover to more easily be pulled over the gameball 35. A drawstring 56 is also provided to assist in securing the ball cover 50 around the gameball 35. As discussed further below, the zipper 58 and drawstring 56 additionally serve as educational aids for teaching the child several dressing skills.

In a preferred embodiment, the head 48 has at its base a hole 60 that is sufficiently large to allow a child's finger to be inserted therethrough. Consequently, when the head section 30 is detached from the body section 35, it may be used as a puppet, thus providing the child with a different toy for play.

Furthermore, when the multi-purpose doll 20 is disassembled, the gameball 35 provides the child with another different toy for play. In FIG. 2, the gameball 35 resembles a basketball. Preferably, however, the amusement set includes other gameballs resembling a football, volleyball, bowling ball, and soccer ball, and which can be used to replace the gameball 35 in the multi-purpose doll 20. The gameballs preferably are made of foam rubber, making the gameballs easier and safer to handle. The gameball 35 and the leg stand 40 are each provided with a friction patch 45A and 45B, respectively, such as that sold under the trademark Velcro, to allow the components to be removably attached to one another.

The leg stand 40 is preferably made of plastic and has a generally hour-glass shape with overemphasized thighs and kneecaps. The leg stand 40 also has a simulated pair of tennis shoes 61 which point at an approximately forty-five degree angle. The tennis shoes 61 are provided with a series of holes 63 through which shoe laces 64 may be threaded. The shoe laces provide an additional educational aid for teaching a child dressing skills.

As mentioned above, the leg stand 40 houses a motorized unit (not shown in FIG. 2) for propelling forward and turning the doll. In a preferred embodiment, the leg stand 40 is supported on three wheels, two front wheels 62 and a rear drive wheel 65. The rear drive wheel 65 is coupled to the motorized unit, whereas the two front wheels 62 are attached to the base of the leg stand for free rotation. The front wheels 62 are not coupled to the motorized unit but are provided in order to add stability.

The motorized unit within the leg stand 40 is remotely controlled by the user 25 by operating a remote control unit 70 (FIG. 1). The remote control unit 70 may send control signals to the motorized unit within the leg stand 40 by a hard-wire connection 72 (FIG. 1) or by radiowaves or infrared signals.

Figure 3:
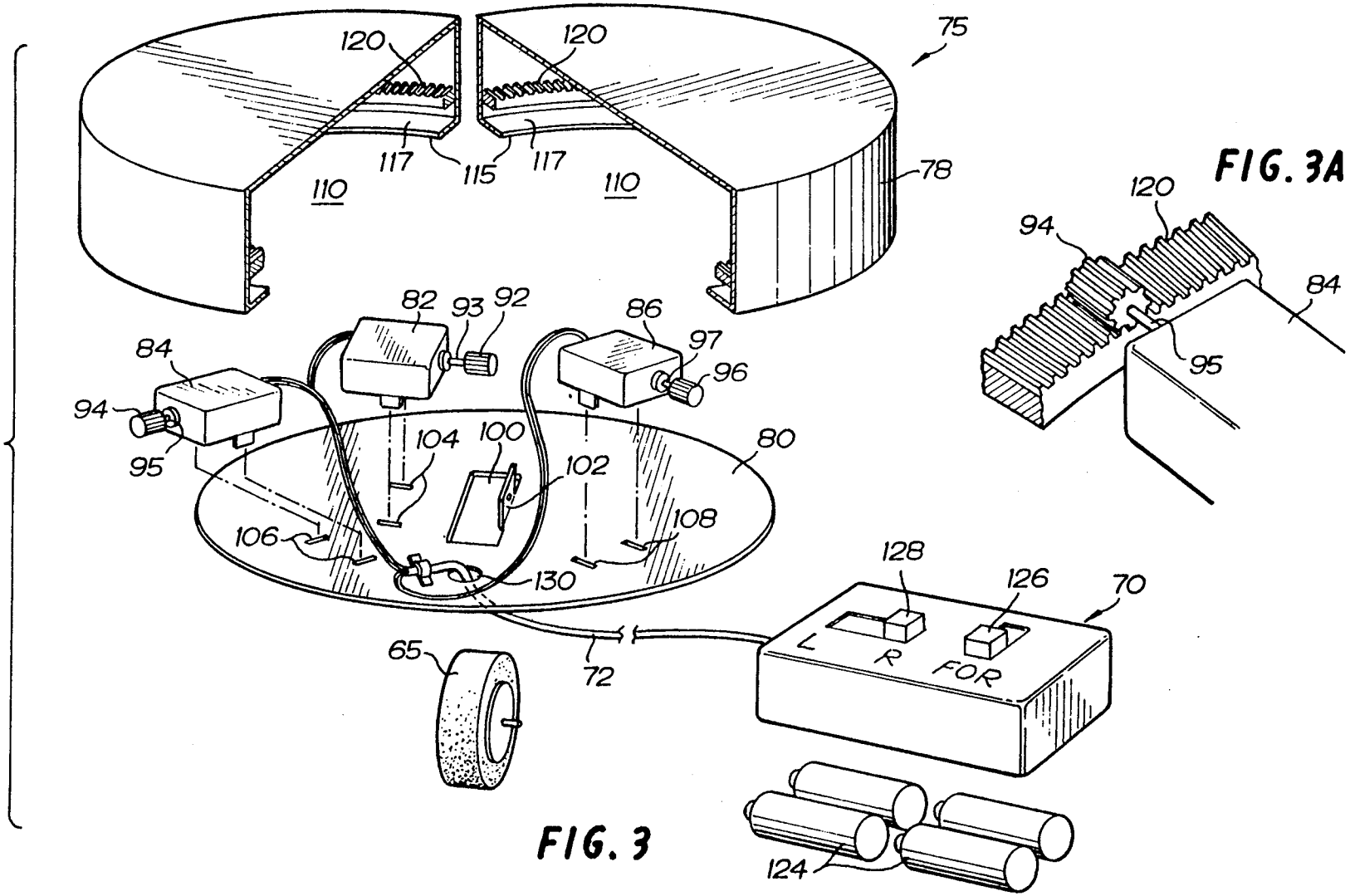
FIG. 3 is an exploded perspective view of the motorized unit for propelling the multi-purpose doll.
Figure 4:
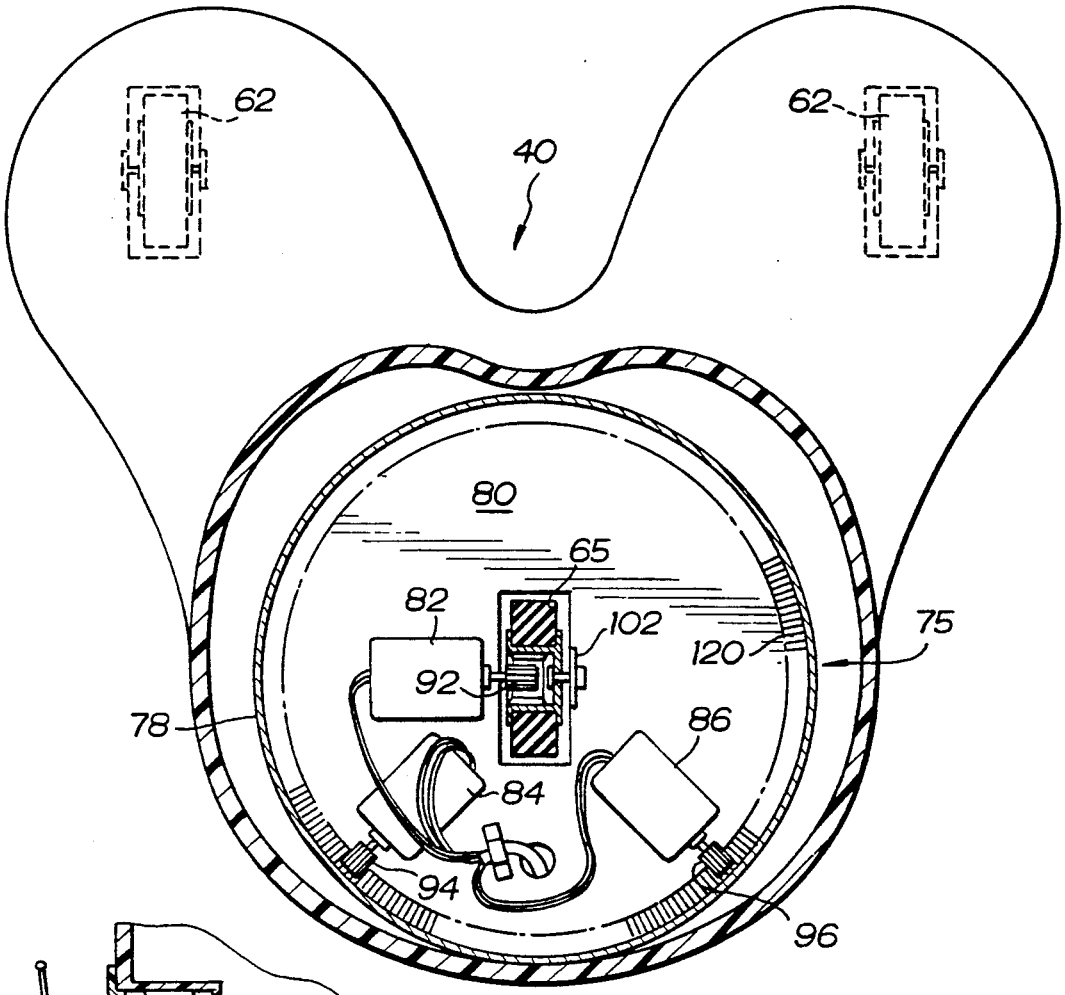
FIG. 4 is a cross-sectional view of the leg stand and motorized unit as viewed from above.

FIGS. 3 and 4 illustrate a preferred embodiment of a motorized unit 75 for propelling the doll. The unit 75, which is housed in the leg stand 40, comprises a drive wheel cover 78 that encloses a guide or turning disk 80 and several motors 82, 84, and 86. The drive wheel cover 78 is fixingly secured to the leg stand 40 by suitable means. The motors 82, 84, and 86 are operable to rotate a respective spur gear 92, 94, and 96 positioned at distal ends of the respective motor drive shafts 93, 95 and 97.

The disk 80 has a wheel opening 100 in which the drive wheel 65 is inserted. When the motorized unit 75 is fully assembled, the wheel 65 is pivotally attached to a wheel brace 102 on the disk 80. The motor 82 is mounted to the disk 80 opposite the wheel brace at motor mounts 104 such that the spur gear 92 may drivingly engaged the base of the wheel 65 as shown in FIG. 4. Motors 84 and 86 are mounted to the disk at motor mounts 106 and 108 such that the drive shafts 95 and 97 and gear spurs 94 and, 96 point radially outward from the center of the disk 80.

The drive wheel cover 78 is divided into two halves which, when joined together, form a generally flat cylinder with a relatively large opening 110 on the underside. The underside of the drive wheel cover 78 has a flange 115 that projects inwardly around the entire circumference of the drive wheel cover 78. The flange 115 has a bearing surface 117 on the interior surface thereof.

Disposed within the cover 78 and above the flange 115 is a spur rack 120 which extends about the entire inner circumference of the cover 78. When the unit 75 is fully assembled, the disk 80 is positioned between the flange 115 and spur rack 120. The spurs 94 and 96 of the motors 84 and 86, respectively, engage the upper surface of the spur rack 120. FIG. 3A is a partial exploded view of the spur 94 engaging the spur rack 20. As shown, the spur 94 and rack 120 have corresponding grooves.

In the embodiment shown in FIG. 3, the motors 82, 84, and 86 are coupled to the remote control unit 70 by a hard-wire 72. The disk 80 has an opening 130 situated near the motor mounts 106 and 108 in order to provide access of the control hard-wire 72 to the individual motors. The remote unit control 70 houses several batteries 124 that supply the necessary power to the motors. In order to cause the doll to move forward, the user may operate a forward switch 126 on the remote control unit 70. The switch 126 controls delivery of power from the batteries 124 to the motor 82 in order to drive the wheel 65, causing the drive wheel to rotate about a substantially horizontal axis. The terms "horizontal" and "vertical" are relative terms used for clarity but are not intended to limit the position of the multipurpose doll.

If the user wishes to turn the doll to the left or right, he or she may activate the left/right switch 128 control unit 70 in order to send power to either motor 84 or motor 86. The motors 84 and 86 each are arranged to operate such that the respective spurs 44 and 46 rotate in opposite directions. When power is delivered to one of the motors 84 or 86 the corresponding spur gear is driven over the spur rack 120 pulling the disk 80 along and causing it to turn about a substantially vertical axis. Operation of the other motor causes the disk 80 to turn in the opposite direction. Since the wheel 65 is mounted to the disk 80, it too turns when the disk 80 is turned. Turning of the disk 80 causes the wheel 65 to also turn about a substantially vertical axis. In this way, directional control of the doll can be achieved.

With the spur gears 94 and 96 resting on the spur rack 120, the respective drive shafts 95 and 97 carry a portion of the load produced by the weight of the disk 80 and the motors 82, 84 and 86 mounted on top of the disk. Another portion of the load, however, is carried by the flange 115. Preferably, a bearing surface is provided on the underside of the disk 80 in correspondence with the bearing surface 117 on the flange 115 so that the disk may easily glide over the flange 115 when the disk is rotated.

Figure 5:
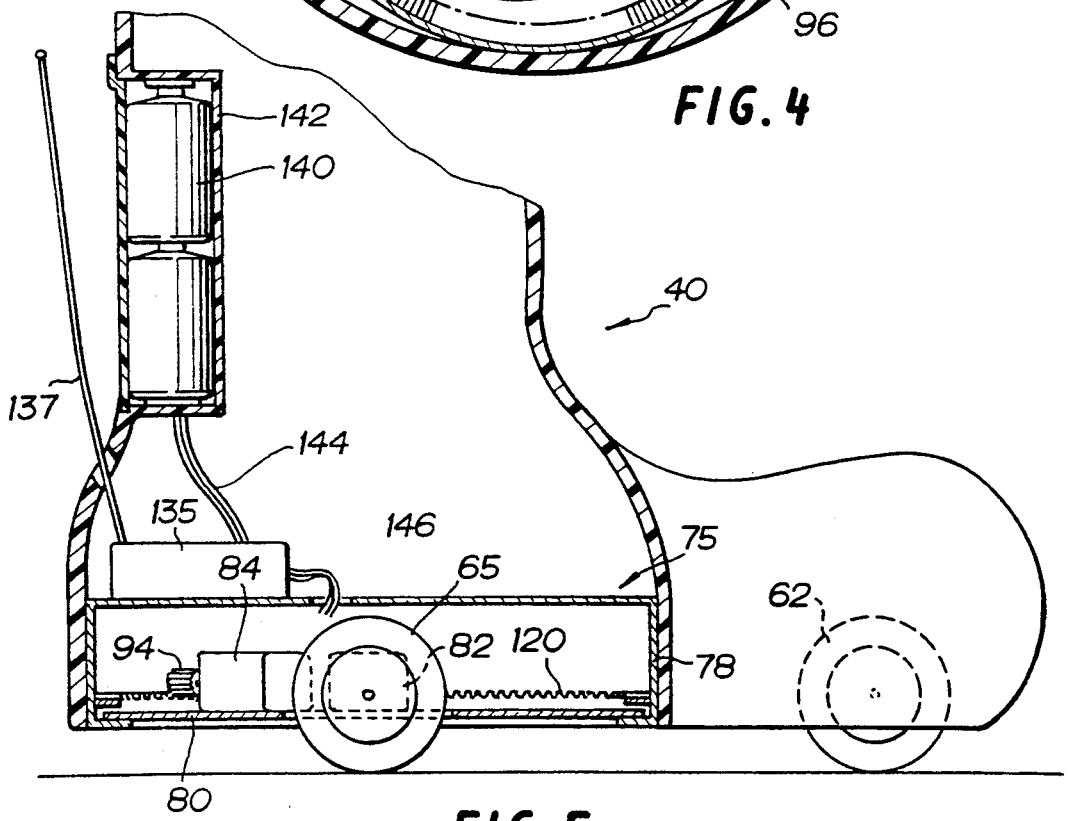
FIG. 5 is a side cross-sectional view of the leg stand and motorized unit in accordance with a second embodiment of the invention.
Figure 7:
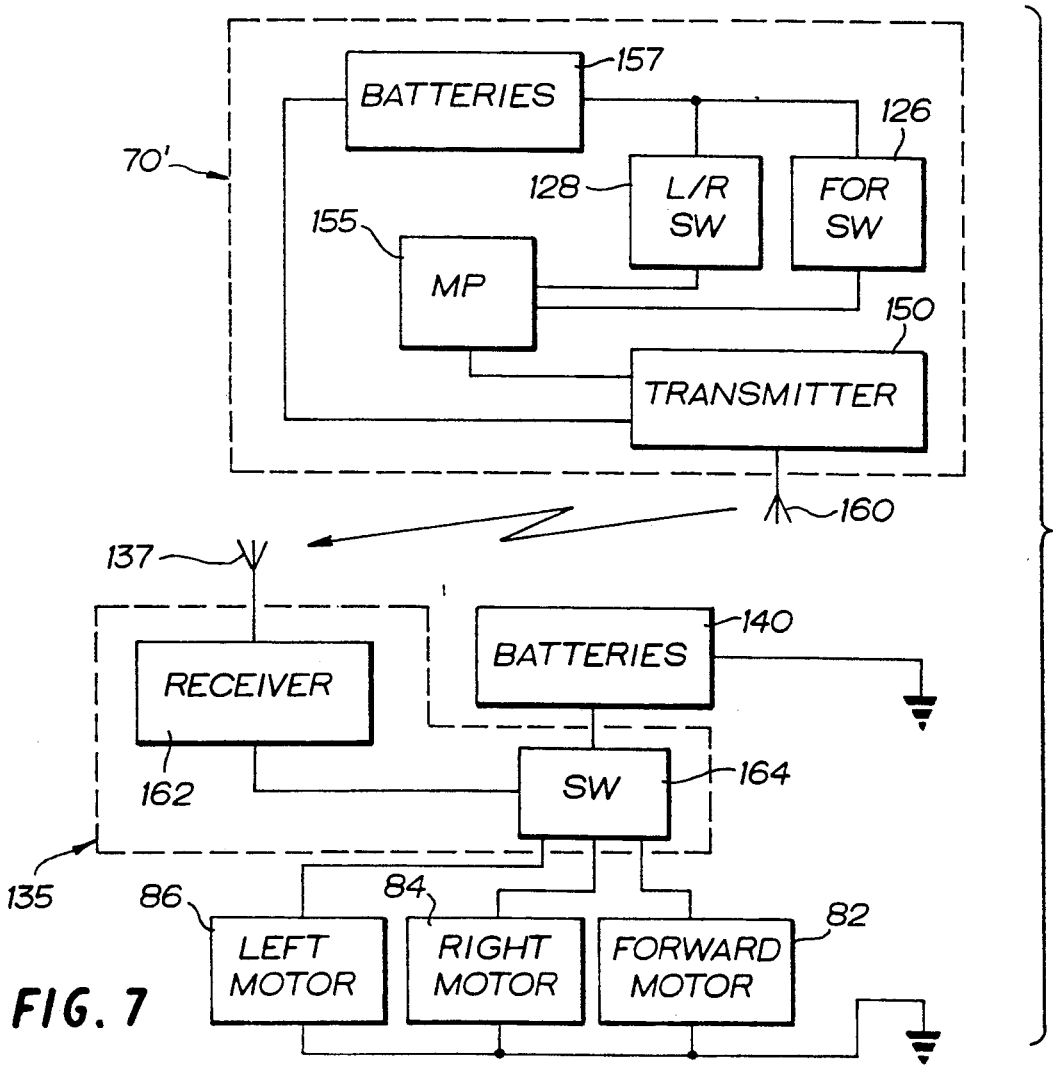
FIG. 7 is a schematic circuity diagram of the second embodiment of the invention.

FIG. 5 illustrates a second embodiment of the motorized unit and control system, wherein the remote control system employs radiowave signals rather than a hardwire connection between the remote control unit and the motors. In particular, FIG. 5 shows a side cross-sectional view of the leg stand 40 and the motorized unit 75. This embodiment is similar to that shown in FIGS. 3 and 4 except that a receiver 135 is provided in the leg stand 40 for receiving signals from a transmitter located in a modified remote control unit 70' (FIG. 7). The receiver 135 includes an antenna 137 for receiving the signals. Batteries 140 for powering the receiver 135 and motors 82, 84 and 86 are housed in a battery enclosure 142 positioned in a backside of the leg stand 40. The batteries 40 are coupled to the receiver 135 through line 144. The receiver 135 in turn is coupled to the motors 82, 84, and 86 via line 146. (For clarity the complete connection is not illustrated in FIG. 5).

Figure 6:
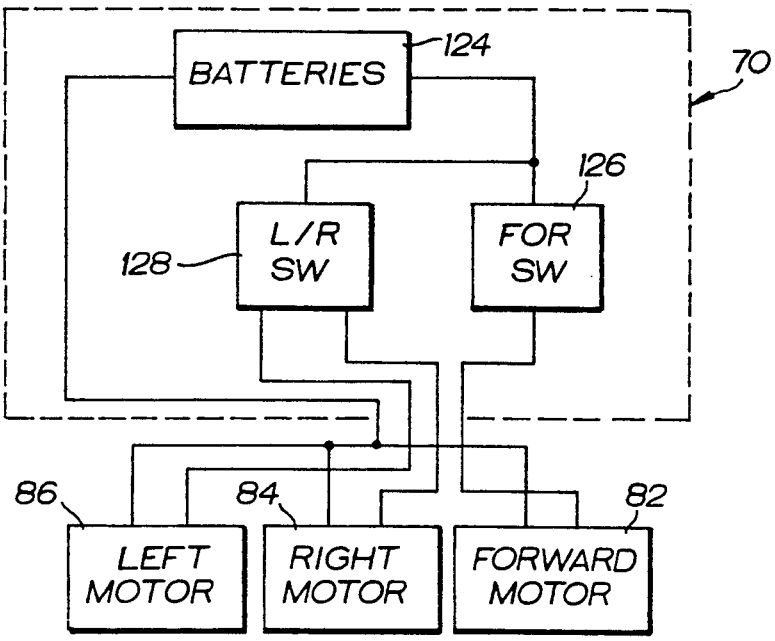
FIG. 6 is a schematic circuitry diagram.

FIGS. 6 and 7 illustrate a schematic of the circuitry that may be employed for the two embodiments of the control systems. With reference to FIG. 6, the circuitry illustrated corresponds to the first embodiment wherein hard-wire connections are made between the remote control unit 70 and the motors 82, 84, and 86 (as shown in FIGS. 3 and 4). The batteries 124 that are housed in the remote control unit 70 are coupled to the forward switch 126 and the left/right switch 128. Activation of the switches allows power to be supplied from the batteries 124 to the particular motors 82, 84, and 86 in the leg stand 40.

With reference to FIG. 7, the modified remote control unit 70' of the second embodiment houses a transmitter 150, a microprocessor chip 155, and batteries 157 for powering the transmitter. The batteries 157 are coupled to the forward switch 126 and left/right switch 128. The switches in turn are coupled to the microprocessor chip 155. The microprocessor 155 converts the signals received from the switches 126 and 128 into control signals and sends the control signals to the transmitter 15 for transmission via antenna 160 to the receiver antenna 137 on leg stand 40. The receiver antenna 137 provides the control signals to the receiver unit 135. The receiver unit 135 includes a receiver 162 that is coupled to a switch 154. The switch 154 responds to the control signals received by the receiver 162 in order to send power from the batteries 140 to selected ones of the motors 82, 84, and 86.

As explained above, the multi-purpose doll 20 provides the child with multiple toys with which to play. The child may use the multi-purpose doll 20 in its assembled or disassembled configuration. When assembled, the doll 20 functions as an action toy that can be remotely controlled to move forward and turn to the left or right. Furthermore, the child can manipulate the zipper 58, drawstring 56, and shoe laces 64 and thereby practice different dressing skills. When disassembled, the head section 30 may function as a puppet and the body section 35 provides a gameball that may be used in conjunction with various sporting accessories provided with the action amusement set.

Figure 8:
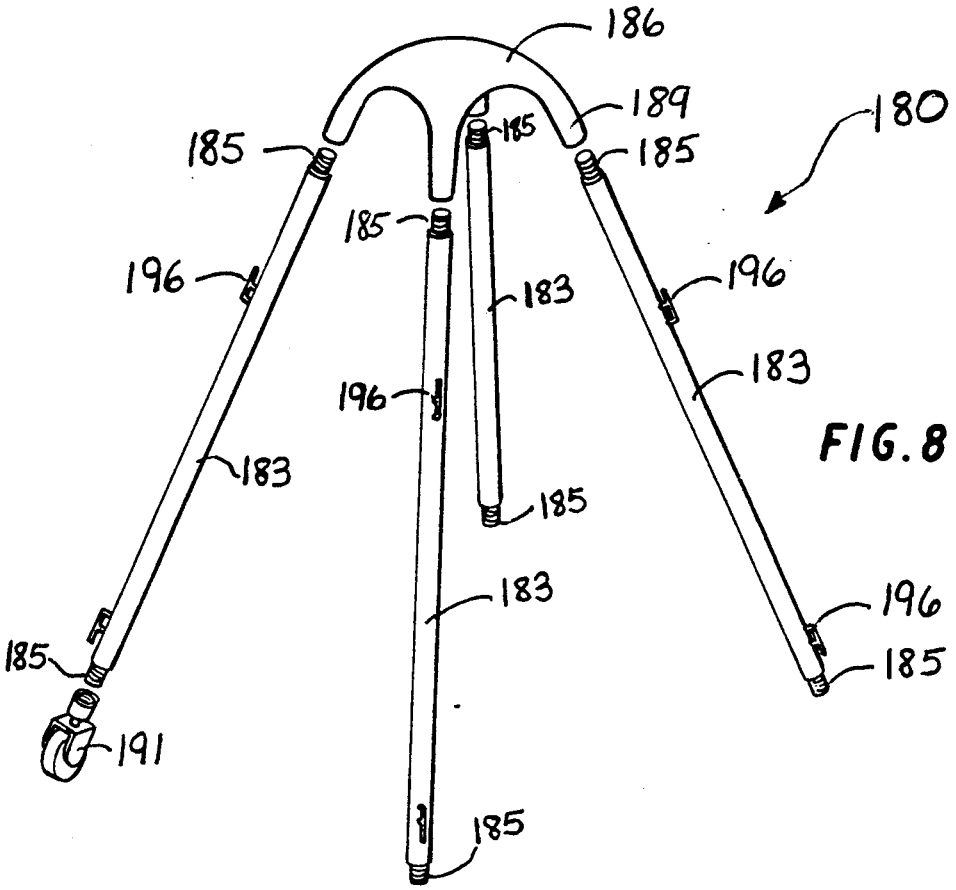
FIG. 8 is an exploded perspective view of a tripod accessory.

FIGS. 8 through 14, illustrate the sporting accessories included in the amusement set and various sporting setups that can be arranged from the accessories. With reference to FIG. 8, the primary accessory is a tripod assembly 180 comprising three legs or poles 183 and a tri-joint connector 186. The legs 183 have threaded ends 185 that allow the legs 183 to be connected to the connector 186 and other accessories. The connector 186 is provided with corresponding threaded bores in extensions 189. Also shown in FIG. 8 is one of a plurality of casters 191 that are included in the amusement set and which can be screwed to the ends of the legs 183 so that the tripod assembly 180 can be easily moved.

The tripod components preferably are made of aluminum or plastic but may be made of other suitable material. As illustrated in the remaining FIG. 8–13, the tripod components can be arranged with other accessories of the action set to create sporting setups corresponding to a bowling game, soccer game, football game, basketball game, volleyball game, and weightlifting game.

Figure 9:
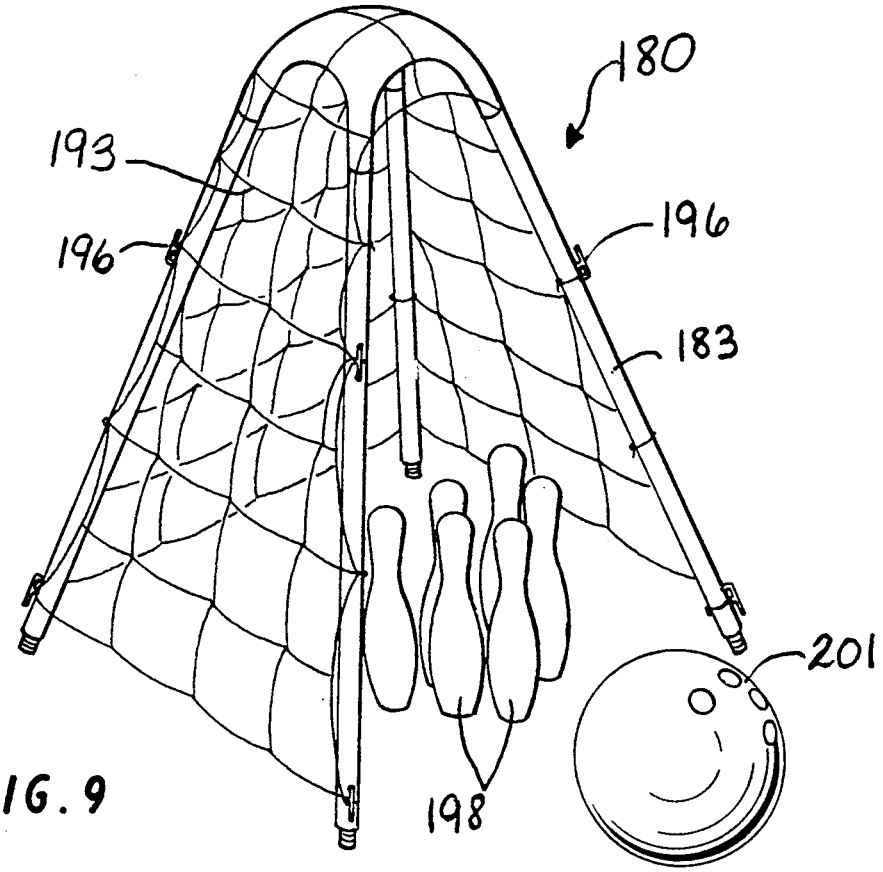
FIG. 9 is a perspective view of a bowling game setup.

With reference to FIG. 9, the tripod assembly is arranged with a nylon net 193 positioned about the fully assembled tripod 180, a plurality of plastic bowling pins 198, and a gameball 201 resembling a bowling ball in order to create a bowling game setup. The net 193 is held in place by looping portions of the net about the tripod 180 and tying the net to the legs 183 with string. With the accessories so arranged, a child can roll the gameball 201 to the pins 198 and practice knocking them down. Alternatively, the child can remove the bowling pins 198 and practice kicking a gameball resembling a soccer ball into the net and thereby practice soccer kicking skills.

Figure 10:
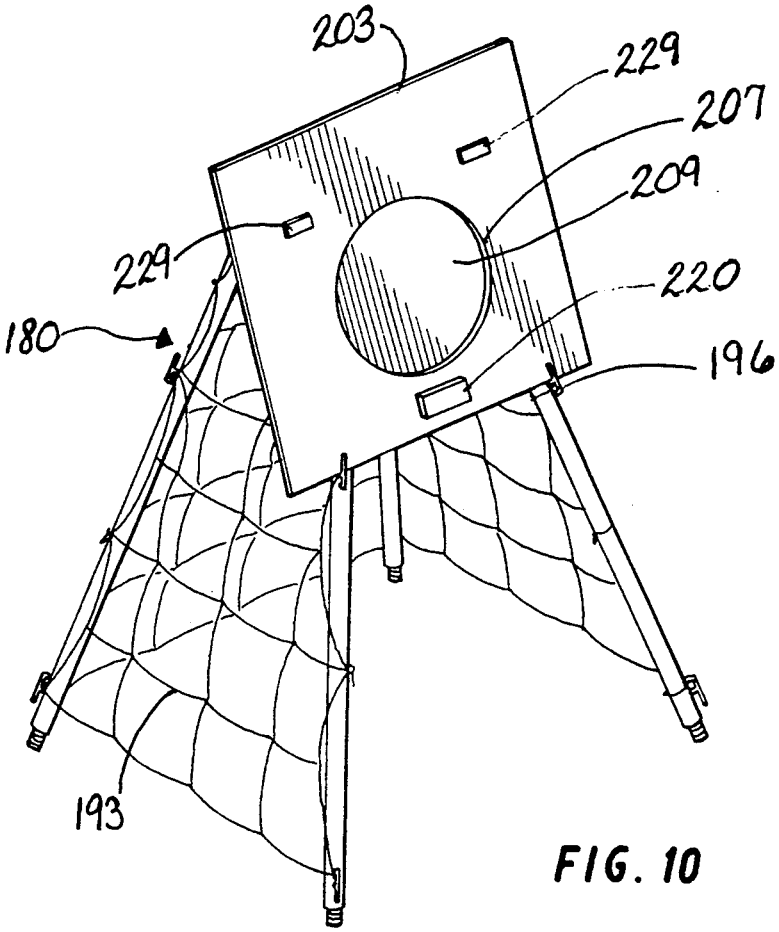
FIG. 10 is a perspective view of a football game setup.
Figure 11A:
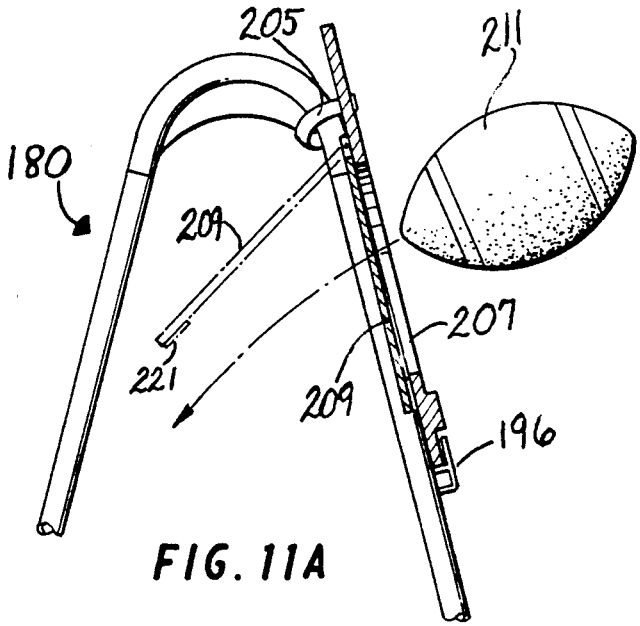
FIG. 11*a* is a side cross-sectional view of the football game setup of FIG. 10.
Figure 11B:
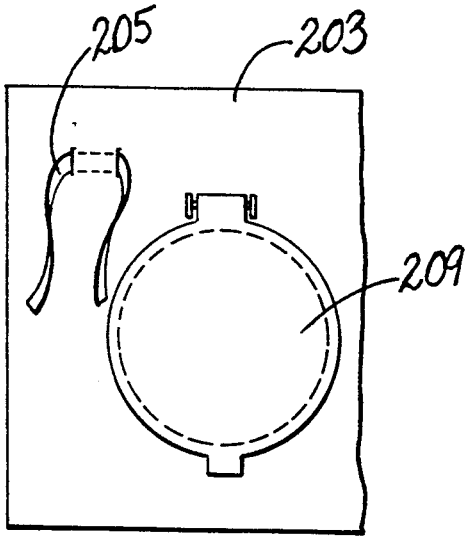
FIG. 11*b* is a partial rear view of the backboard of FIG. 10.

With reference to FIGS. 10 through 11B, a football game setup is shown whereby the tripod 180 is assembled with the net 193 and a plastic backboard accessory 203 attached to the front tripod legs. The backboard 203 is attached to the tripod legs by inserting the lower edge of the backboard 203 into brackets 196 on the front tripod legs and tying the upper portion of the backboard 203 to the front tripod legs by straps 205 provided on the rear of the backboard 203. The backboard 203 has a central hole 207 that can be covered by a plate 209 pivotally hinged to the rear of the backboard as shown in FIGS. 11A and 11B. During play, the child tosses a gameball 211, that is shaped like a football, through the opening 207 pushing the plate 209 rearwardly. In this way, the child can practice the skill of throwing a football accurately. If desired, the plate 209 may be removed thus allowing easy passage of the gameball 211 through the opening 207.

Figure 12:
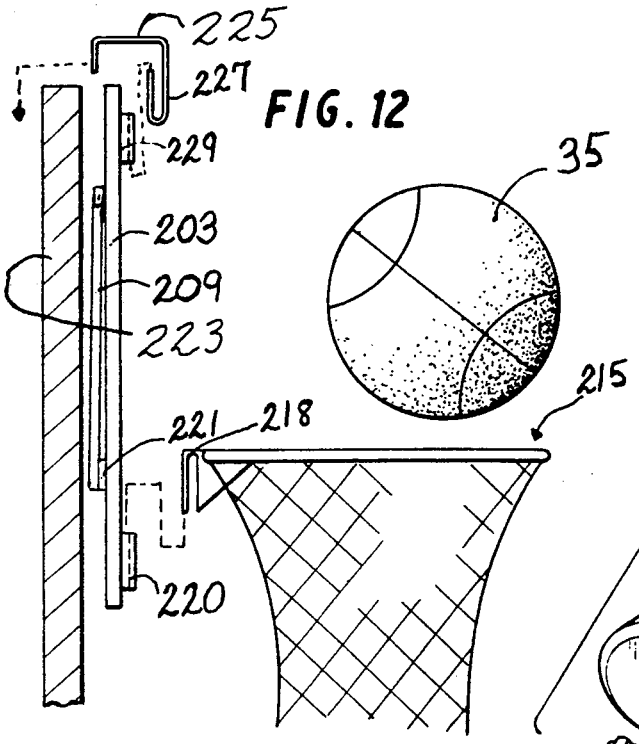
FIG. 12 illustrates a side exploded view of a basketball game setup.

As illustrated in FIG. 12 the backboard 203 can be used separate from the tripod to arrange a basketball game setup. Preferably, the action set accessories include a basketball hoop and net 215 having a rear bracket 218 that may be inserted through a bracket 220 provided centrally on the backboard 203. Separate brackets 225, only one of which is shown in FIG. 12, are provided for attaching the backboard 203 and hoop 215 to the top of a door or the like. Each bracket 225 has a hook portion 227 that may be slipped through a respective bracket 229 on the backboard 203. The remaining portion of the bracket 225 can be slipped over the top of the door 223. With this setup, the child can practice tossing the gameball 35 through the hoop 215 and thus develop basketball shooting skills. Alternatively, the backboard 203 and hoop 215 can be mounted to the tripod assembly in the same manner as the football game setup of FIG. 10. In either case the rear plate may be held in place by friction patches 221 to prevent the rear plate from moving.

Figure 14:
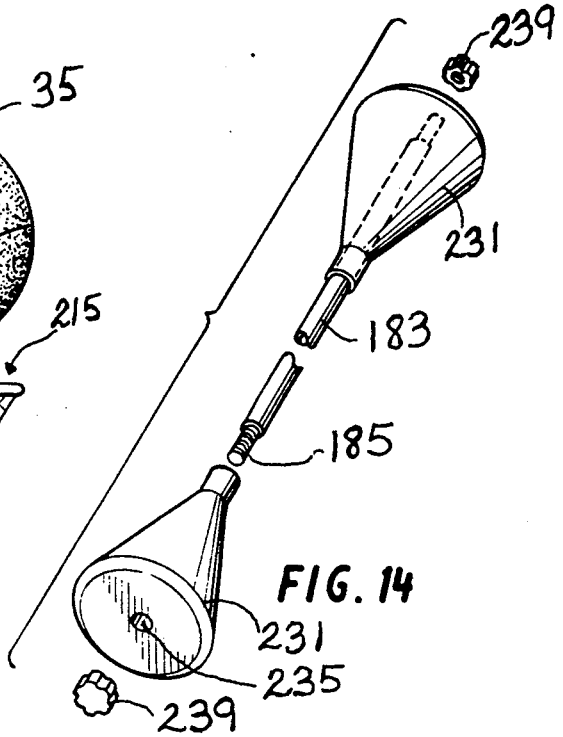
FIG. 14 illustrates an exploded, fragmented perspective view of a weight lifting setup.
Figure 13:
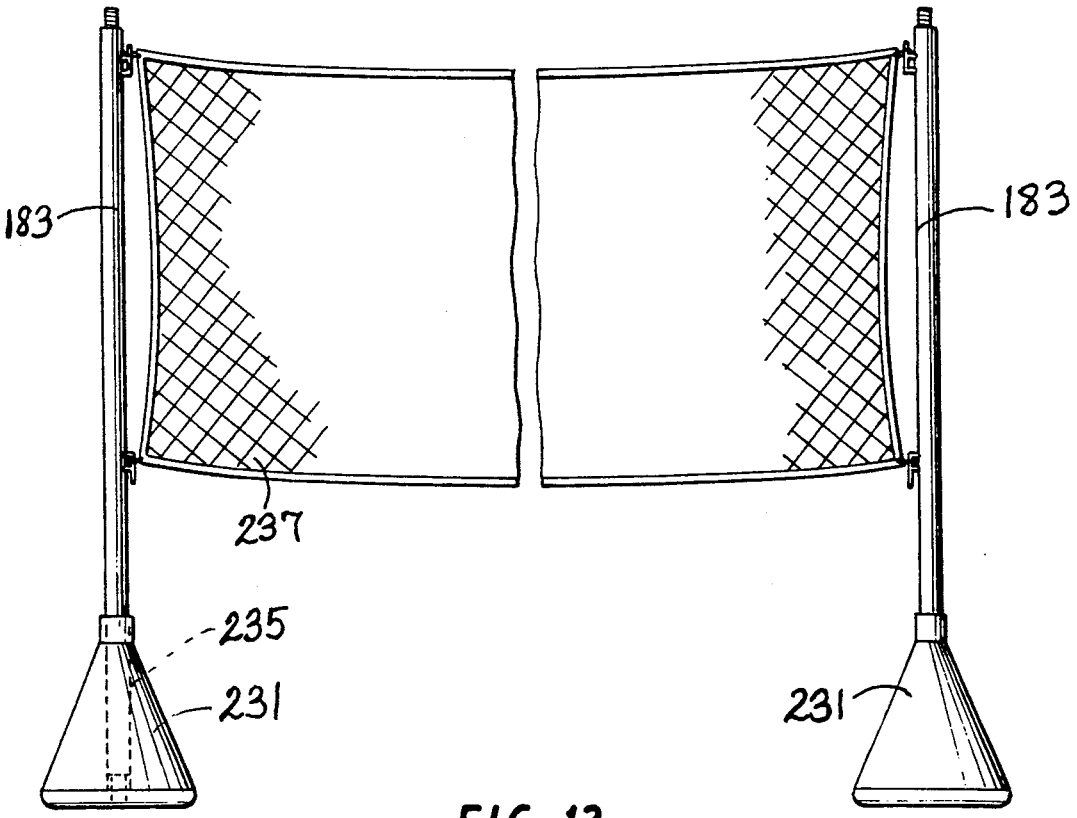
FIG. 13 illustrates a fragmented forward view of a volleyball game setup.

With reference to FIGS. 13 and 14, the sporting accessories further include two cone-shaped rubber bases 231 having through-holes 235 through which an end of a leg 183 may be inserted. As shown in FIG. 13, two of the legs 183 may be inserted into respective bases 231 and a nylon net 237 connected there between in order to arrange a volleyball setup. The bases provide stability for holding the net 237 and legs 183 upright. With the volleyball setup, two or more children can practice hitting a gameball having the shape of a volleyball over the net 237.

As shown in FIG. 14, the pair of bases 231 can be attached to opposite ends of a leg 183 to create a weight lifting setup. The bases 231 are held on the leg 183 by screwing nuts 239 over the threaded ends of the leg. With this weight lifting setup a child can practice weight lifting techniques.

As can be appreciated from the foregoing description of the invention, the action amusement set can provide a child with the ability to play multiple games by manipulating and arranging certain of the components of the action set. In doing so, the child can learn various basic motor skills involved in several different sports which the child may encounter more fully in later years as well as learn motor skills necessary for dressing oneself. Furthermore, by providing the child with action set components that may be interchanged, a child may use his or her imagination to create different setups.

Although the present invention has been described with reference to preferred embodiments, it should be understood that the invention is not limited to the details thereof. A number of possible substitutions and modifications have been suggested in the foregoing detailed description, and others will occur to those of ordinary skill in the art. Any such substitutions and modifications are intended to fall within the scope of the invention as defined in the appended claims.

What is claimed is:

1. A multi-purpose doll, comprising:

a head section;

a torso section removably attachable to said head section, said torso section comprising a gameball;

a leg section removably attachable to said torso section;

a drive mechanism provided in said leg section for propelling and turning the leg section; and a remote control mechanism for remotely controlling said drive mechanism;

wherein the doll can be disassembled and the head section and torso section used separately by a child.

2. A multi-purpose doll according to claim 1, wherein said head section comprises a head member and a ball cover attached to said head member, wherein said ball cover substantially surrounds said gameball when the doll is fully assembled.

3. A multi-purpose doll according to claim 2, wherein said ball cover is provided with a zipper and a drawstring.

4. A multi-purpose doll according to claim 1, wherein said leg section includes a pair of simulated shoes provided with shoe laces.

5. A multi-purpose doll according to claim 2, wherein said head member is provided with a hole sufficiently large to allow a child's finger to be inserted therein, said hole being positioned at a base portion of said head member such that said head section may operate as a puppet when the doll is disassembled.

6. A multi-purpose doll according to claim 1, wherein said torso section and said leg section are each provided with at least one friction patch for allowing the torso section to be removably attached to said leg section.

7. A multi-purpose doll according to claim 1, wherein said gameball is made of foam rubber.

8. A multi-purpose doll according to claim 1, wherein said drive mechanism comprises:

a first drive source;

a drive wheel coupled to said first driving source and protruding at least partially outside said leg section, a second drive source, and a turning disk coupled to said second driving source and said drive wheel;

wherein said first drive source is operable to rotate said drive wheel about a substantially horizontal axis, thereby causing said leg section to move forward, and said second drive source is operable to rotate said turning disk, thereby causing said drive wheel and said leg section to turn about a substantially vertical axis.

9. A multi-purpose doll according to claim 8, wherein said drive mechanism further comprises a rack fixedly attached to said leg section, and a spur gear coupled to said second drive source and engageable with said rack;

wherein said turning disk is rotated by operating said second drive source to drive said spur gear across said rack.

10. A multi-purpose doll according to claim 8, wherein said drive mechanism further comprises a rack fixedly attached to said leg section;

wherein said second drive source includes first and second spur gears engageable with said rack; and wherein turning disk may be rotated in a first direction by operating said second drive source to drive said first spur gear across said rack in one direction and may be rotated in a second direction by operating said second drive source to drive said second spur gear across said rack in a direction opposite that of the first spur gear.

11. A multi-purpose doll according to claim 10, wherein said second drive source further includes first and second drive motors coupled to said turning disk for driving said first and second spur gears, respectively.

12. A multi-purpose doll according to claim 9, wherein said drive mechanism further comprises a cover fixedly attached to said leg section and on which said rack is carried, said cover surrounding said turning disk and said drive wheel.

13. A multi-purpose doll according to claim 12, wherein said cover includes a flange having a bearing surface and on which said turning disk is supported.

14. A multi-purpose doll according to claim 13, wherein said rack is spaced apart from said flange and said turning disk is positioned therebetween.

15. A multi-purpose doll according to claim 1, wherein said remote control mechanism includes a control unit housing a power source and at least one wire coupling said power source to said drive mechanism.

16. A multi-purpose doll according to claim 1, further comprising a power source housed in said leg section and a receiver coupled to said power source and said drive mechanism, wherein said remote control mechanism includes a transmitter for sending control signals to said receiver in order to control said drive mechanism.

17. An action amusement set for use by a child, comprising:

a multi-purpose doll, comprising a head section, a torso section removably attachable to said head section, said torso section comprising a gameball, a leg section removably attachable to said torso section, a drive mechanism provided in said leg section for propelling and turning the leg section, and a remote control mechanism for remotely controlling said drive mechanism;

a plurality of replacement gameballs interchangeable with said first gameball in said torso section; and a plurality of sporting accessories usable in connection with said first and said replacement gameballs.

18. An action amusement set according to claim 17, wherein said sporting accessories include a tripod assembly comprising three legs and a tri-joint connector for removably connecting said legs, and a net adapted to partially surround said tripod assembly, said tripod assembly and said net forming a goal into which a child can kick, roll, or throw one of said first and said replacement gameballs.

19. An action amusement set according to claim 18, wherein said sporting accessories further include a backboard adapted to be mounted to said tripod assembly and having an opening through which one of said first and said replacement gameballs can be thrown.

* * * * *